US010336504B2

(12) United States Patent
Prezecki, II

(10) Patent No.: US 10,336,504 B2
(45) Date of Patent: Jul. 2, 2019

(54) STORAGE DEVICE WITH INFINITELY ADJUSTABLE STORAGE DIVIDER SYSTEM

(71) Applicant: FORD GLOBAL TECHNOLOGIES, LLC, Dearborn, MI (US)

(72) Inventor: Leonard Gus Prezecki, II, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 498 days.

(21) Appl. No.: 14/944,889

(22) Filed: Nov. 18, 2015

(65) Prior Publication Data

US 2017/0137177 A1 May 18, 2017

(51) Int. Cl.
*B65D 25/06* (2006.01)

(52) U.S. Cl.
CPC ..... *B65D 25/06* (2013.01)

(58) Field of Classification Search
CPC . B65D 1/24; B65D 1/26; B65D 7/065; B65D 25/04; B65D 25/06; F25D 23/12; A47F 5/005; A47B 88/20
USPC ..... 220/528–533, 551; 312/401–402, 404, 312/407, 348.3; 62/382; 248/173, 448, 248/458, 460; D7/555, 387, 549; 249/131, 171; D3/313; 206/708; 211/70.6, 106, 133.4, 107, 169, 169.1, 211/165, 97, 69, 78, 163, 85.23
See application file for complete search history.

(56) References Cited

U.S. PATENT DOCUMENTS 1,290,186 A * 1/1919 Held ..... A47J 36/20 126/9 B
2,903,127 A * 9/1959 Dorman ..... B65D 25/04 206/338
3,720,346 A * 3/1973 Cypher ..... B65D 25/06 220/254.4
4,736,856 A * 4/1988 Alneng ..... A47F 5/05 211/131.1
4,966,295 A * 10/1990 Parrish ..... A47G 19/025 206/459.1
5,074,777 A * 12/1991 Garner ..... A21B 3/13 220/531
D384,861 S * 10/1997 Richard ..... D7/357
D395,377 S * 6/1998 Wallays ..... D7/387
(Continued)

FOREIGN PATENT DOCUMENTS

CN 101508376 A 8/2009
CN 201545274 U 8/2010
(Continued)

OTHER PUBLICATIONS

English machine translation of CN201816520U.
(Continued)

*Primary Examiner* — Chun Hoi Cheung
*Assistant Examiner* — Brijesh V. Patel
(74) *Attorney, Agent, or Firm* — Vichit Chea; King & Schickli, PLLC

(57) ABSTRACT

A storage device is provided. That storage device includes a sidewall defining a storage compartment and a storage divider system including a hub. That hub is held in the storage compartment and a plurality of telescoping panels extend between the hub and the sidewall to divide the storage compartment into individual chambers.

11 Claims, 7 Drawing Sheets

(56) References Cited

U.S. PATENT DOCUMENTS 6,105,654 A * 8/2000 Martel ..... F25D 23/069 16/225
6,871,921 B2 * 3/2005 Ernst ..... A47B 88/90 220/529
7,163,119 B2 * 1/2007 Besselman ..... A47B 96/04 220/534
8,281,939 B2 * 10/2012 Chen ..... H05B 3/16 211/13.1
2001/0004817 A1 * 6/2001 Auer ..... E04B 2/7438 52/238.1
2004/0020055 A1 * 2/2004 Zuker ..... A21C 15/04 30/114
2006/0099057 A1 5/2006 Fair
2006/0272466 A1 * 12/2006 Atwater ..... A21C 11/106 83/620
2008/0041799 A1 * 2/2008 Nguy ..... B25H 3/023 211/70.6
2008/0129167 A1 * 6/2008 Rand ..... F25D 23/021 312/330.1
2009/0063166 A1 * 3/2009 Palmer ..... A47F 5/06 211/133.4
2009/0255891 A1 * 10/2009 Lanning ..... A47B 96/04 211/183
2010/0319391 A1 * 12/2010 Lim ..... F25D 25/025 62/441
2014/0210331 A1 * 7/2014 Tunzi ..... F25D 25/00 312/404
2014/0238995 A1 * 8/2014 Vargas ..... B65D 25/08 220/523
2014/0265802 A1 * 9/2014 Wilcox ..... F25D 25/025 312/404
2014/0290069 A1 * 10/2014 White, III ..... B26D 3/24 30/114
2015/0208840 A1 * 7/2015 Honeycutt ..... A47G 19/30 414/800
2015/0239631 A1 * 8/2015 Kinskey ..... B65D 81/02 220/4.22

FOREIGN PATENT DOCUMENTS

CN 201816520 U 5/2011
CN 202163735 U 3/2012
DE 102005037188 A1 2/2007
DE 102008049759 A1 4/2010
DE 102011100835 B3 3/2012
EP 1854672 A3 9/2009

OTHER PUBLICATIONS

English machine translation of DE102005037188A1.
English machine translation of DE102008049759A1.
English machine translation of DE102011100835B3.
English machine translation of EP1854672A3.
English Machine Translation of CN101508376A dated Aug. 19, 2009.
English Machine Translation of CN201545274U dated Aug. 11, 2010.
English Machine Translation of CN202163735U dated Mar. 14, 2012.
Notification of First Office Action from State Intellectual Property Office of the People's Republic of China Application No. 201610994066.6 dated Mar. 25, 2019.

* cited by examiner

STORAGE DEVICE WITH INFINITELY ADJUSTABLE STORAGE DIVIDER SYSTEM

TECHNICAL FIELD

This document relates generally to the storage device field and, more particularly, to a storage compartment equipped with an infinitely adjustable storage divider system for dividing the storage compartment into individual chambers customized to meet the needs of the user.

BACKGROUND

It has long been known to provide dividers in a storage compartment in order to partition the storage compartment into individual chambers. Such prior art dividers do not offer the user with a way to truly and effectively customize the storage compartment to hold the items which the individual wishes to store.

This document relates to a new and improved storage device wherein the storage compartment of that device includes a storage divider system having a displaceable hub and a plurality of telescoping panels that extend between the hub and the sidewall of the storage compartment. Advantageously, such a system allows the user to divide the storage compartment into what amounts to a virtually infinite number of individual chamber configurations. Thus, the storage device disclosed herein allows one to fully customize the storage chamber to effectively meet the needs of any particular application and hold various items as desired by the user.

SUMMARY

In accordance with the purposes and benefits described herein, a storage device is provided. That storage device comprises a sidewall defining a storage compartment and a hub held in the storage compartment. Further, the storage device includes a plurality of telescoping panels that extend between the hub and the sidewall. Those telescoping panels divide the storage compartment into individual chambers in substantially any configuration desired by the user.

Significantly, the hub is displaced within the storage compartment relative to the sidewall. The hub includes a lock for securing the plurality of the telescoping panels in any selected position. Further the hub includes a plurality of hinge keys and each panel of the plurality of telescoping panels includes a keyway for receiving and holding one hinge key of the plurality of hinge keys.

The plurality of hinge keys may be received on a shaft. The end of that shaft may be threaded. Further, in one possible embodiment the lock comprises a knob that is received on the threaded end of the shaft. When that knob is tightened down on the threaded shaft, the plurality of telescoping panels are secured and locked in selected positions.

In accordance with a further aspect, the sidewall may include a guide track. Further each panel of the plurality of telescoping panels may include a guide roller that is captured in and follows that guide track.

In one particularly useful embodiment, the guide track extends continuously along the sidewall and includes radiused corners.

Each panel of the plurality of panels may include a stabilizer rib. Further, the sidewall may include a locator channel for receiving the stabilizer rib of each panel of the plurality of telescoping panels. In one particularly useful embodiment, that locator channel extends continuously along the sidewall. Together, the continuous guide track and the continuous locator channel provide for substantially infinite adjustability of the plurality of telescoping panels as they extend from the hub to the sidewall.

In one possible embodiment, the storage device includes a bottom wall. The sidewall is fixed to the bottom wall while the hub is displaceable along the bottom wall within the sidewall.

In accordance with an additional aspect, a method is provided for dividing a storage compartment into an infinite configuration of individual chambers. That method may be broadly described as comprising the steps of: (1) providing a storage compartment within a sidewall and (2) positioning a storage divider system within that sidewall. The storage divider system includes a hub and a plurality of telescoping panels extending between the hub and the sidewall to divide the storage compartment into the individual chambers.

The method may further include the step of reconfiguring the individual chambers by displacing the hub within the storage compartment. Further, the method may include reconfiguring the individual chambers by changing the included angle defined at the hub between any two adjacent panels of the plurality of telescoping panels. Still further, the method may include reconfiguring the individual chambers by increasing or decreasing the number of the plurality of telescoping panels extending between the hub and the sidewall. Any one or a combination of any two or all three of these reconfiguring steps may be utilized to allow an individual to customize the storage compartment with individual chambers suited to meet the needs of the user.

In the following description, there are shown and described several preferred embodiments of the storage device. As it should be realized, the storage device is capable of other, different embodiments and its several details are capable of modification in various, obvious aspects all without departing from the storage device as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of the storage device and together with the description serve to explain certain principles thereof. In the drawing figures.

Figure 1:
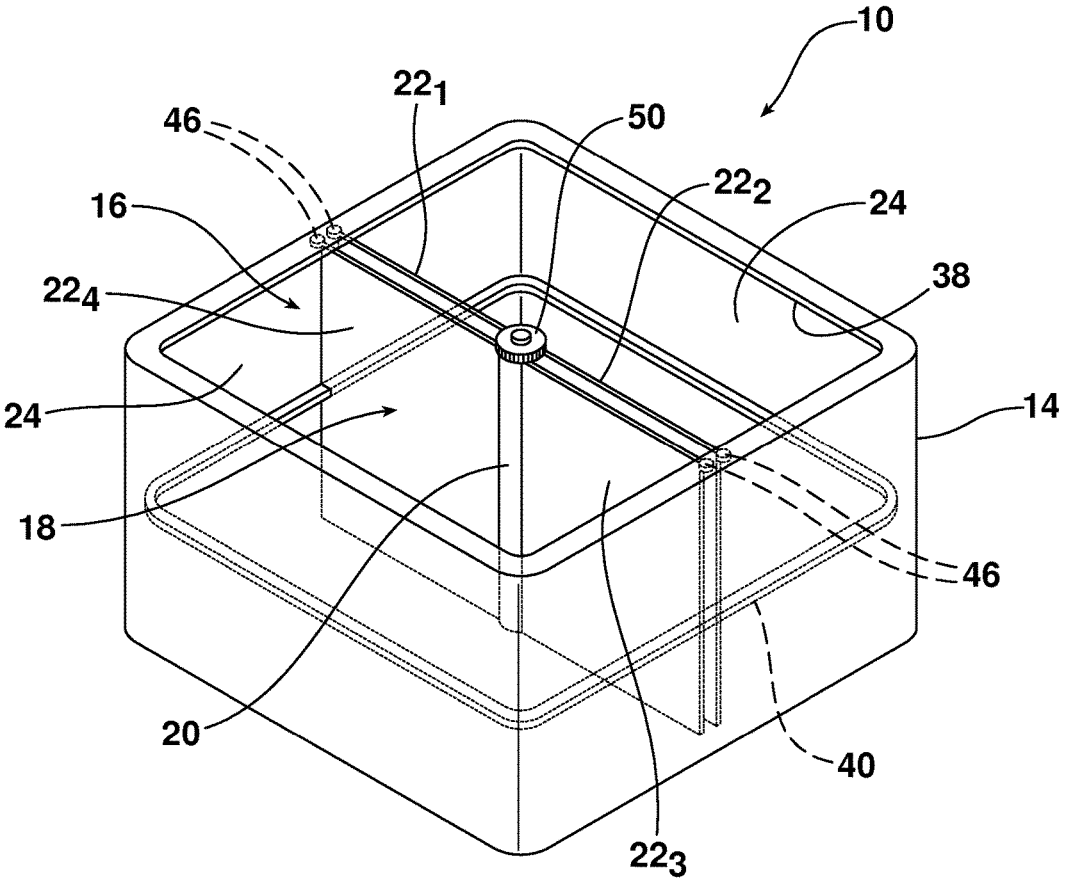
FIG. 1 is a perspective view of the storage device.
Figure 2A:
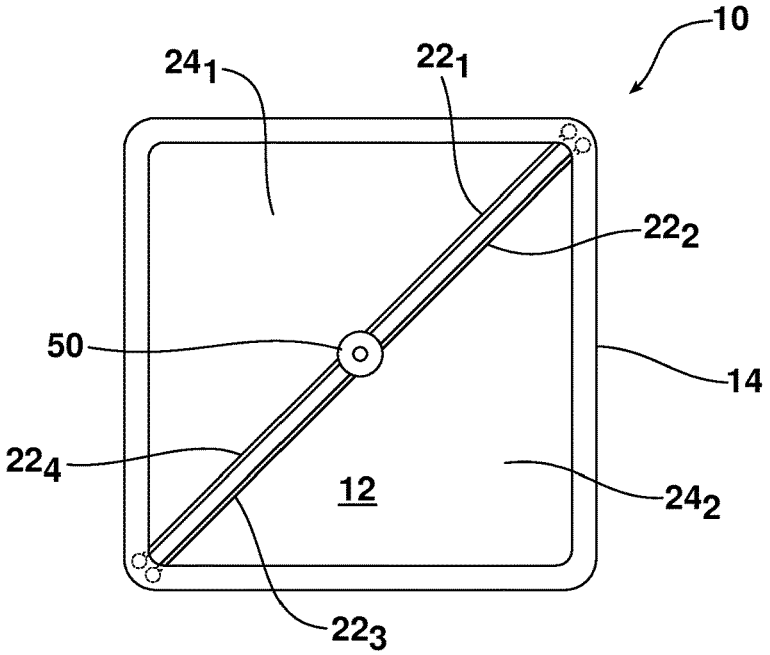
FIGS. 2A-2E illustrate only five of a potentially infinite number of ways the storage compartment may be configured into individual chambers.
Figure 2B:
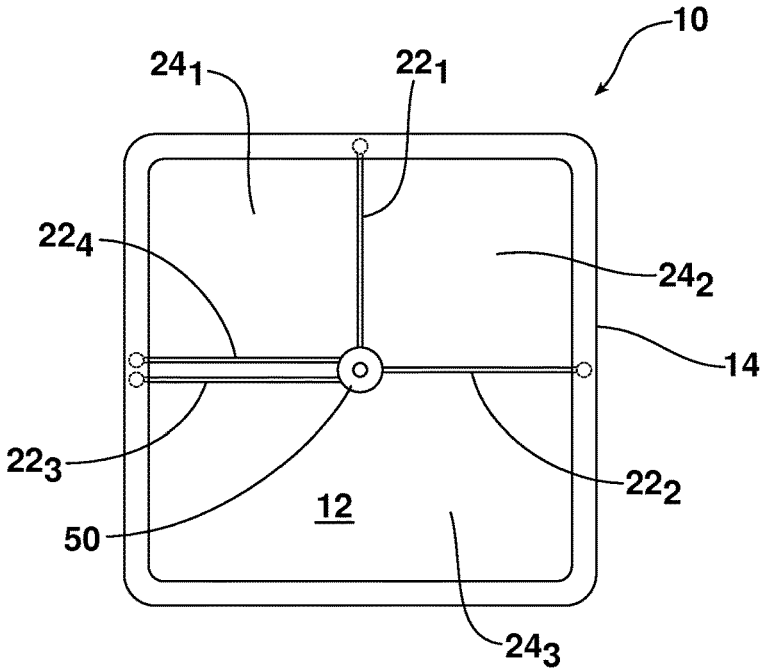
Figure 2C:
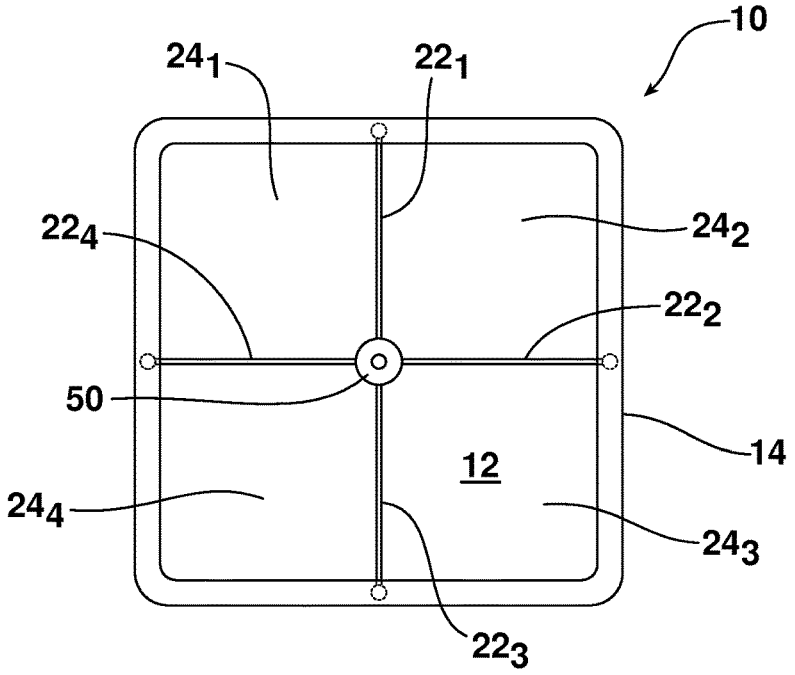
Figure 2D:
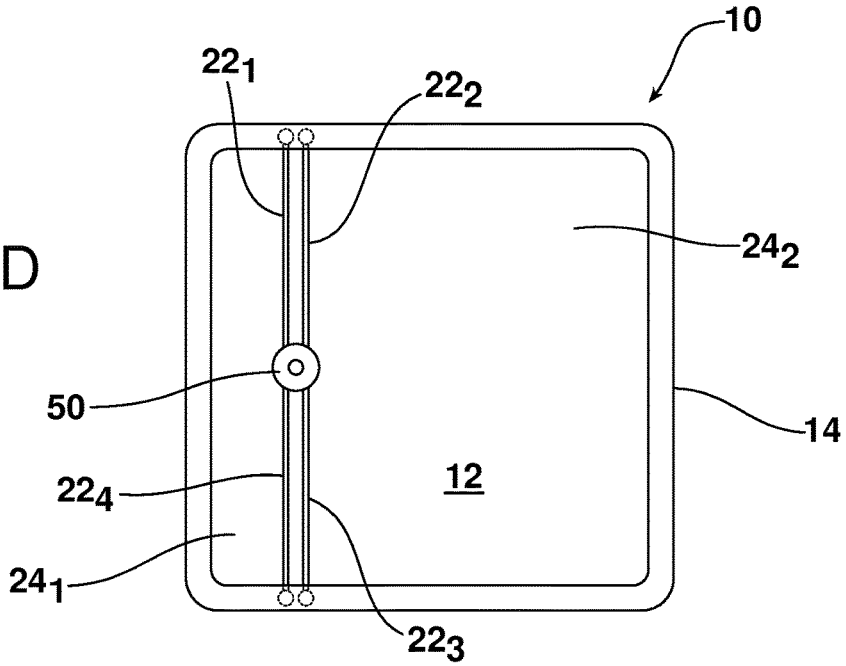
Figure 2E:
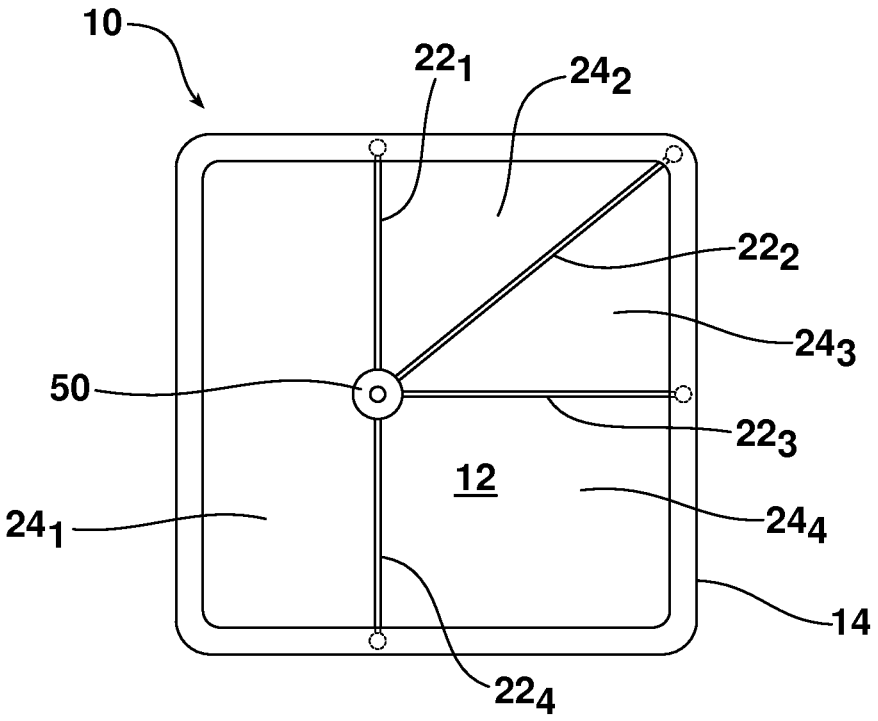

Reference will now be made in detail to the present preferred embodiments of the storage device, examples of which are illustrated in the accompanying drawing figures.

DETAILED DESCRIPTION

Reference is now made to FIGS. 1-5 illustrating the storage device 10 which includes a bottom wall 12 and a sidewall 14 defining a storage compartment 16. As illustrated, the storage device 10 also includes a storage divider system 18 comprised of a hub 20 and a plurality of telescoping panels $\mathbf{22}_1$, $\mathbf{22}_2$, $\mathbf{22}_3$, $\mathbf{22}_4$. As illustrated, the plurality of telescoping panels $\mathbf{22}_1$-$\mathbf{22}_4$ extend between the hub 20 and the sidewall 14 dividing the storage compartment 16 into individual chambers $\mathbf{24}_1$-$\mathbf{24}_n$. In the embodiment illustrated in FIGS. 1-3, the storage device 10 includes four telescoping panels $\mathbf{22}_1$-$\mathbf{22}_4$. As should be appreciated, however, the storage device 10 may include substantially any desired number of telescoping panels $\mathbf{22}_1$-$\mathbf{22}_n$ to divide the storage compartment 16 into any number of desired chambers $\mathbf{24}_1$-$\mathbf{24}_n$. In most applications the storage device 10 will include between two and six telescoping panels $\mathbf{22}_1$-$\mathbf{22}_n$. As should be appreciated, however, if desired, the storage device 10 may include only one telescoping panel $\mathbf{22}_1$ or as many telescoping panels as desired above six.

As should be appreciated for reviewing FIGS. 2A-2E, the hub 20 of the storage device 10 is displaceable along the bottom wall 12 and within the sidewall 14 into substantially any desired position. Further, the included angle defined between any two adjacent telescoping panels $\mathbf{22}_1$-$\mathbf{22}_n$ may also be adjusted as desired. As a result, each storage compartment 16 may be divided into a substantially infinite number of different chamber configurations. Five such configurations are illustrated in FIGS. 2A-2E.

Figure 3:
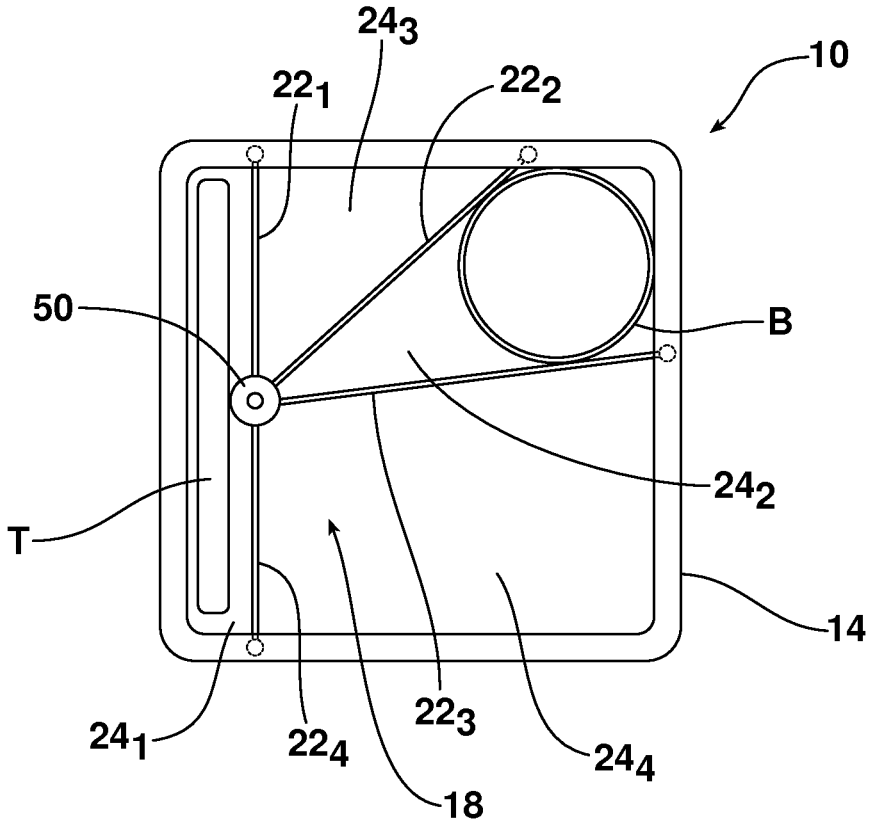
FIG. 3 is a detailed top plane view of yet another possible configuration illustrating how the storage device may be easily configured to hold a tablet or a phone in one compartment and a beverage can in another.

FIG. 3 illustrates yet another configuration including one chamber $\mathbf{24}_1$ sized and shaped to hold a tablet or phone T, a second chamber $\mathbf{24}_2$ sized and shaped to hold a drinking beverage B and two additional storage chambers $\mathbf{24}_3$ and $\mathbf{24}_4$ for holding substantially any other article desired by the user.

Figure 4:
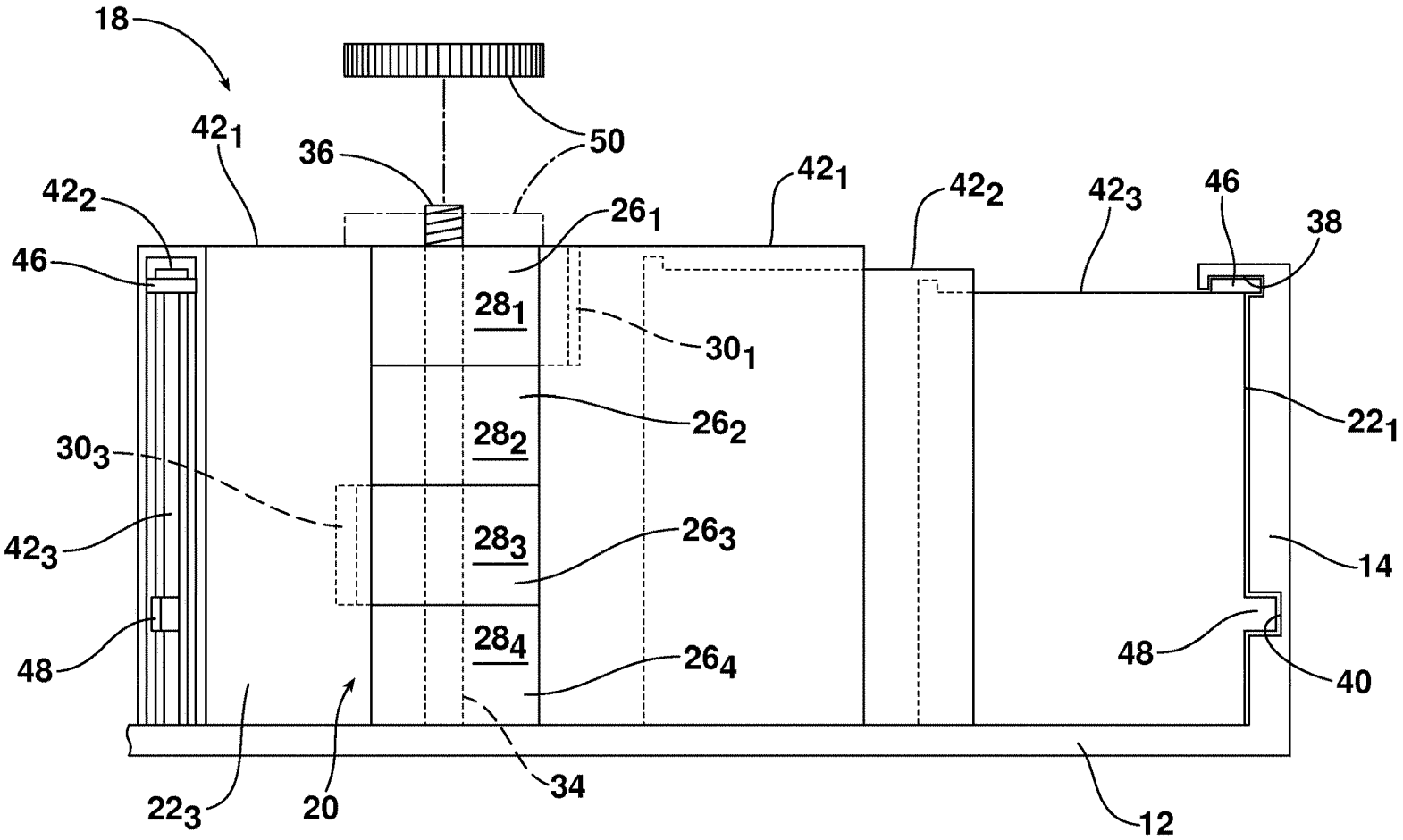
FIG. 4 is a schematic side elevational view illustrating in detail the hub and sidewall of the storage device as well as two of the plurality of telescoping panels extending between the hub and the sidewall that are utilized to divide the storage compartment into individual chambers.
Figure 5:
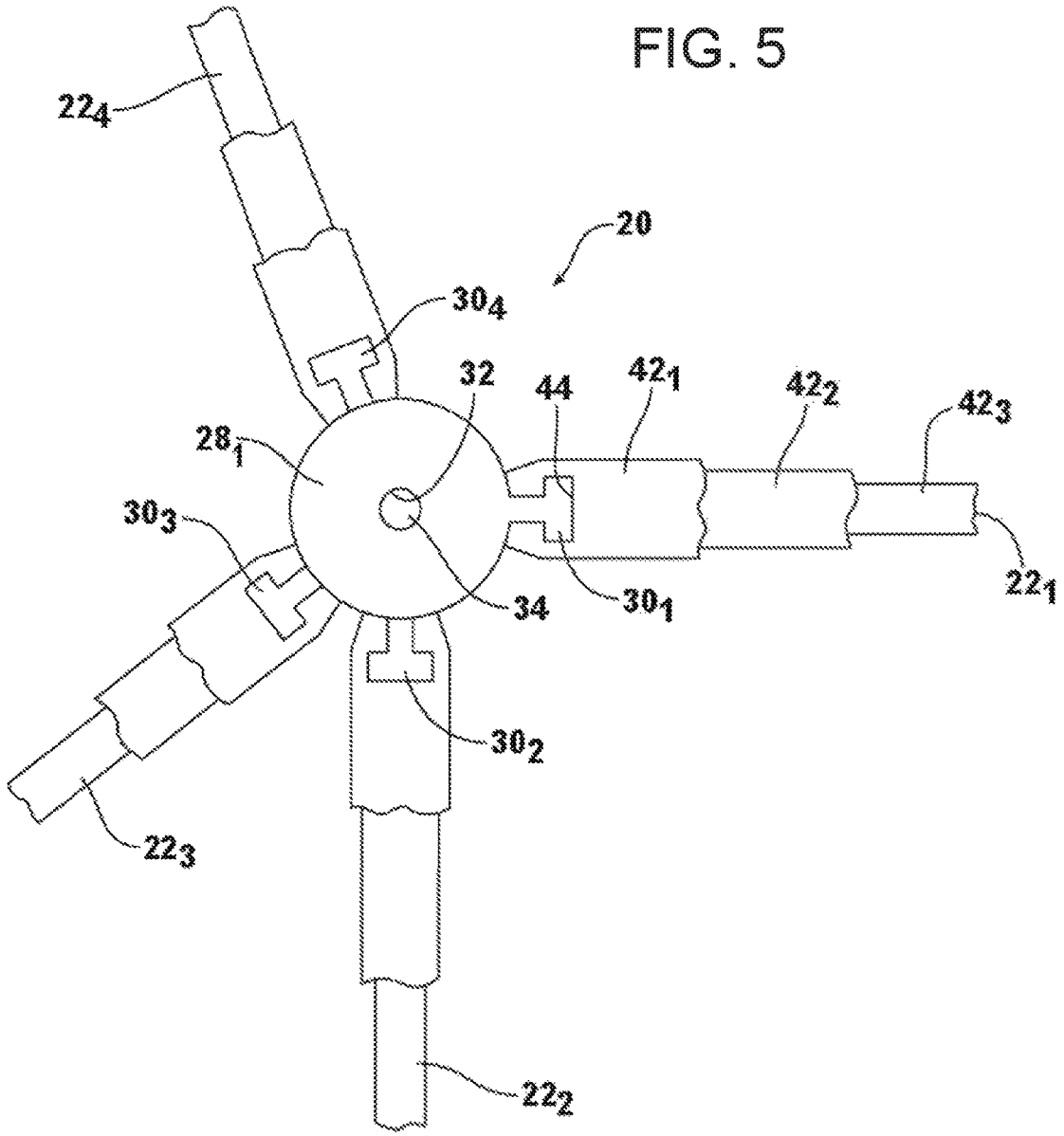
FIG. 5 is a detailed top plan view of the hub and the cooperating keyways in the telescoping panels that connect the telescoping panels to the hub via the hinge keys.

Reference is now made to FIGS. 4 and 5 illustrating the structural aspects of the storage divider system 18 including, particularly, the hub 20, the sidewall 14 and the telescoping panels $\mathbf{22}_1$-$\mathbf{22}_n$ that allow the storage compartment 16 to be divided into substantially any configuration of chambers $\mathbf{24}_1$-$\mathbf{24}_n$.

As illustrated, the hub 20 includes a plurality of hinge keys $\mathbf{26}_1$-$\mathbf{26}_n$. Each hinge key $\mathbf{26}_1$-$\mathbf{26}_n$ comprises a cylindrical shaped body $\mathbf{28}_1$-$\mathbf{28}_n$, a projecting key $\mathbf{30}_1$-$\mathbf{30}_n$ and a central aperture 32 in the body. As illustrated, the hinge keys $\mathbf{26}_1$-$\mathbf{26}_n$ are stacked onto a shaft 34 so that the shaft extends through the central aperture 32 in the body $\mathbf{28}_1$-$\mathbf{28}_n$ of each hinge key. As further illustrated, at least the end 36 of the shaft 34 is threaded.

The sidewall 14 includes a guide track 38. That guide track 38 extends continuously along the sidewall 14 and includes radiused corners (see also FIG. 1). In addition, the sidewall 14 includes a locator channel 40 that also extends continuously along the sidewall including around the radiused corners.

As best illustrated in FIGS. 4 and 5, each panel $\mathbf{22}_1$-$\mathbf{22}_n$ of the plurality of telescoping panels has a telescoping body. In the illustrated embodiment, that telescoping body includes three sections $\mathbf{42}_1$, $\mathbf{42}_2$ and $\mathbf{42}_3$. One end of each panel $\mathbf{22}_1$-$\mathbf{22}_n$ includes a keyway 44 for receiving and holding one key $\mathbf{30}_1$-$\mathbf{30}_n$ of the hinge keys $\mathbf{26}_1$-$\mathbf{26}_n$ and thereby connecting that first end of the panel $\mathbf{22}_1$-$\mathbf{22}_n$ to the hub 20.

The second or opposite end of each panel $\mathbf{22}_1$-$\mathbf{22}_n$ of the plurality of panels includes a guide roller 46 that is captured in and follows the guide track 38 of the sidewall 14. Further, each panel $\mathbf{22}_1$-$\mathbf{22}_n$ of the plurality of telescoping panels includes a projecting stabilizer rib 48 that is freely received in the locator channel 40 of the sidewall 14. Thus, it should be appreciated that each panel $\mathbf{22}_1$-$\mathbf{22}_n$ includes a guide roller 46 and a stabilizer rib 48 on an end thereof opposite the keyway 44. Together, the guide roller 46 and stabilizer group 48 connect this second end of each panel $\mathbf{22}_1$-$\mathbf{22}_n$ to the sidewall 14. Thus, it should be appreciated that each telescoping panel $\mathbf{22}_1$-$\mathbf{22}_n$ extends continuously between the hub 20 and the sidewall 14.

As should be appreciated the individual chambers 24 of the storage compartment 16 may be reconfigured by: (1) displacing the hub 20 along the bottom wall 12 in the storage compartment 16 and/or (2) changing the included angle defined at the hub 20 between any two adjacent panels $\mathbf{22}_1$-$\mathbf{22}_n$ of the plurality of telescoping panels by rotating the hinge keys $\mathbf{26}_1$-$\mathbf{26}_n$ on the shaft 34 and/or (3) increasing or decreasing the number of the plurality of telescoping panels $\mathbf{22}_1$-$\mathbf{22}_n$ extending between the hub 20 and the sidewall 14. As should be appreciated, the telescoping body of each panel $\mathbf{22}_1$-$\mathbf{22}_n$, the guide roller 46 on each panel captured in the continuous guide track 38 of the sidewall 14 and the stabilizer rib 48 received and sliding through the continuous locator channel 40 in the sidewall 14 accommodate any repositioning of any of the telescoping panels while maintaining those panels so that they fully extend between the hub 20 and the sidewall 14.

Once the hub 20 and telescoping panels $\mathbf{22}_1$-$\mathbf{22}_n$ of the storage divider system 18 have been positioned as desired to divide the storage compartment 16 into a desired, customized arrangement of chambers $\mathbf{24}_1$-$\mathbf{24}_n$, the storage divider system 18 is locked in place. More specifically, the lock in the illustrated embodiment comprises a knob 50 that is threadedly received on the threaded end 36 of the hub shaft 34. When knob 50 is tightened down, the hinge keys $\mathbf{26}_1$-$\mathbf{26}_n$ are secured in position thereby holding all of the telescoping panels $\mathbf{22}_1$-$\mathbf{22}_n$ in place. If and when one wishes to reconfigure the various chambers $\mathbf{24}_1$-$\mathbf{24}_n$ of the storage device 10, the knob 50 may be loosened and the relative position of the hub 20 and the telescoping panels $\mathbf{22}_1$-$\mathbf{22}_n$ with respect to the sidewall 14 may be adjusted as desired. The knob 50 may then be tightened down again to once again secure the storage divider system 18 in position in order to maintain the new customized configuration of the storage device 10.

The foregoing has been presented for purposes of illustration and description. It is not intended to be exhaustive or to limit the embodiments to the precise form disclosed. Obvious modifications and variations are possible in light of the above teachings. All such modifications and variations are within the scope of the appended claims when interpreted in accordance with the breadth to which they are fairly, legally and equitably entitled.

What is claimed:

1. A storage device, comprising:

a sidewall defining a storage compartment, said sidewall including a guide track wherein said guide track extends continuously along said sidewall and includes radiused corners;

a hub held in said storage compartment, said hub including a plurality of hinge keys; and a plurality of telescoping panels extending between said hub and said sidewall and dividing said storage compartment into individual chambers, wherein each panel of said plurality of panels includes a guide roller that is captured in and follows said guide track.

2. The storage device of claim 1, wherein said hub is displaceable within said storage compartment relative to said sidewall.

3. The storage device of claim 2, wherein said hub includes a lock for securing said plurality of telescoping panels in any selected positions.

4. The storage device of claim 3, wherein said hub includes a plurality of hinge keys and each panel of said plurality of said telescoping panels includes a keyway for receiving and holding one hinge key of said plurality of hinge keys.

5. The storage device of claim 4, wherein said plurality of hinge keys are received on a shaft.

6. The storage device of claim 5, wherein an end of said shaft is threaded.

7. The storage device of claim 6, wherein said lock comprises a knob that is received on said threaded end of said shaft and tightened to lock said plurality of telescoping panels in any selected position.

8. The storage device of claim 1, wherein each panel of said plurality of panels includes a stabilizer rib.

9. The storage device of claim 8, wherein said sidewall includes a locator channel for receiving said stabilizer rib of each panel of said plurality of telescoping panels.

10. The storage device of claim 9, wherein said locator channel extends continuously along said sidewall.

11. The storage device of claim 1, wherein said storage device includes a bottom wall, said sidewall is fixed to said bottom wall and said hub is displaceable along said bottom wall within said sidewall.

* * * * *